United States Patent [19]

Silva et al.

[11] 3,973,330

[45] Aug. 10, 1976

[54] CONTROL DEVICE FOR STATIC DRY FEATURE

[75] Inventors: William Silva, Marion; Richard L. Conrath, Herrin, both of Ill.

[73] Assignee: Fedders Corporation, Edison, N.J.

[22] Filed: Apr. 24, 1975

[21] Appl. No.: 571,241

[52] U.S. Cl. ..... 34/55; 34/133

[51] Int. Cl.[2] ..... F26B 11/04

[58] Field of Search ..... 74/527, 553; 192/95; 200/38 B, 38 CA, 61.79, 61.8, 330, 61, 62, 38 A; 34/53, 52, 55, 133

[56] References Cited

UNITED STATES PATENTS

| | | | |
|---|---|---|---|
| 2,813,354 | 11/1957 | Buck | 34/133 |
| 2,839,945 | 6/1958 | Zion | 74/527 |
| 2,978,232 | 4/1961 | Kruzan | 34/133 |
| 3,072,386 | 1/1963 | Horecky | 34/52 |
| 3,169,406 | 2/1965 | Mullen | 74/527 |
| 3,483,632 | 12/1969 | Triplett | 34/133 |
| 3,866,002 | 2/1975 | Underwood et al. | 200/38 A |
| 3,896,277 | 7/1975 | Yaginuma | 200/38 R |

*Primary Examiner*—John J. Camby
*Assistant Examiner*—Larry I. Schwartz
*Attorney, Agent, or Firm*—McAulay, Fields, Fisher & Goldstein

[57] ABSTRACT

A control device is provided for a dryer of the type which is operable to perform first and second cycles wherein in the first cycle the drum of the dryer is rotated by a motor and wherein in the second cycle the drum is stationary. The control device comprises a switch that is movable between an off state and an on state to connect the motor in circuit with a source of energy. An actuating shaft is mounted on the dryer for rotational movement between a first position corresponding to the first cycle of operation of the dryer and a second position corresponding to the second cycle of operation of the dryer and for movement between a normal and a depressed position. The shaft mounts a lever which is positioned to engage said switch to move the switch to the on state when the shaft is in the normal position and is adapted to cause operation of the switch to the off state when the actuating shaft is in the depressed position. Lock means is provided for preventing rotation of the shaft when the shaft is in the normal position and is responsive to movement of the shaft to the depressed position to permit rotation thereof whereby the motor is automatically deenergized when the dryer is switched between the first and second cycles of operation.

15 Claims, 11 Drawing Figures

CONTROL DEVICE FOR STATIC DRY FEATURE

The present invention relates generally to an improved dryer and, more particularly, pertains to a novel control device for a dryer that eliminates undue stresses and strains on the dryer elements.

The conventional home dryer includes a drum that is rotatably mounted within the dryer cabinet. A driving belt encircles the drum and is connected to the output shaft of a motor so that when the motor is energized, the drum is caused to rotate through the belt connection. Moreover, the same motor is utilized to drive other elements within the dryer such as a fan for controlling the flow of hot air through the dryer to dry the articles received within the drum. In many instances it is highly desirable to permit the drum to remain stationary while the hot air flow is maintained. Accordingly, some dryers have been provided with a feature such that the dryer may be switched between a conventional or normal tumble dry cycle in which the drum rotates and a static dry cycle in which the drum is stationary. However, in practice, this type of construction has given rise to a number of problems.

To be more specific, when it is desired to switch from a normal cycle of operation to a static dry cycle of operation, the drive belt is usually disabled. However, the motor must be energized in order to operate the fan, for example. In practice, it has been found that if the dryer is switched between cycles during the time the motor is energized, a severe strain is placed on the driving belt and the other operating parts of the dryer thereby resulting in early failure of the elements.

Accordingly, an object of the present invention is to provide a dryer with an improved control device.

A more specific object of the present invention is to provide a dryer having a control device for switching between a normal tumble dry operation of the dryer and a static dry operation of the dryer that is efficient in operation.

A further object of the present invention is to provide a control device for a dryer that is highly reliable in operation as the dryer is switched between cycles of operation.

Another object of the present invention resides in the novel details of construction that provide a control device of the type described which is operable to automatically deenergize a dryer motor as the dryer is switched between a normal tumble dry cycle and a static dry cycle.

Accordingly, a control device constructed in accordance with the present invention may be utilized with a dryer of the type having a drum movable by a motor and which is operable to perform at least a first type and a second type of cycle. The control device comprises a switch that is movable between an off state and an on state to connect the motor in circuit with a source of energy. An actuating shaft is provided and mounting means mounts the actuating shaft on the dryer for rotational movement between a first position corresponding to the first type of cycle of operation of the dryer and a second position corresponding to the second type of cycle of operation of the dryer and for movement between a normal and a depressed position. Control means on said shaft is engageable with the switch when the actuating shaft is in the normal position to move the switch to the on state. The control means is also operable to cause operation of the switch to the off state when the actuating shaft is in the depressed position. Lock means is provided for preventing rotation of the shaft when the shaft is in the normal position and is responsive to movement of the shaft to the depressed position to permit rotation thereof, whereby the motor is automatically deenergized when the shaft is moved to the depressed position so that the shaft may be rotated between the first and the second positions to select the desired cycle of operation of the dryer.

Other features and advantages of the present invention will become more apparent from a consideration of the following detailed description when taken in conjunction with the accompanying drawings, in which.

Figure 1:
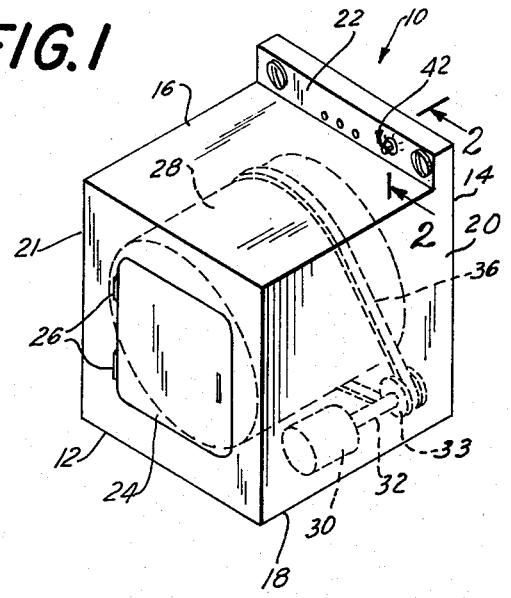
FIG. 1 is a perspective view of a dryer having a control device constructed in accordance with the present invention.

A dryer having a control device constructed according to the present invention is designated generally by the reference numeral 10 in FIG. 1 and includes a front wall 12, a rear wall 14, a top wall 16, a bottom wall 18 and opposed side walls 20 and 21. Upstanding from the top wall 16 is a control panel 22 that mounts the dryer controls. A door 24 is received in a recess in the front panel 12 and is hingedly connected thereto by hinges 26 that permit the door to be opened outwardly to provide access to a drum 28 within the dryer. The drum 28 is rotatably mounted within the dryer by conventional means and is adapted to be rotated by a motor 30 received within the dryer.

Figure 11:
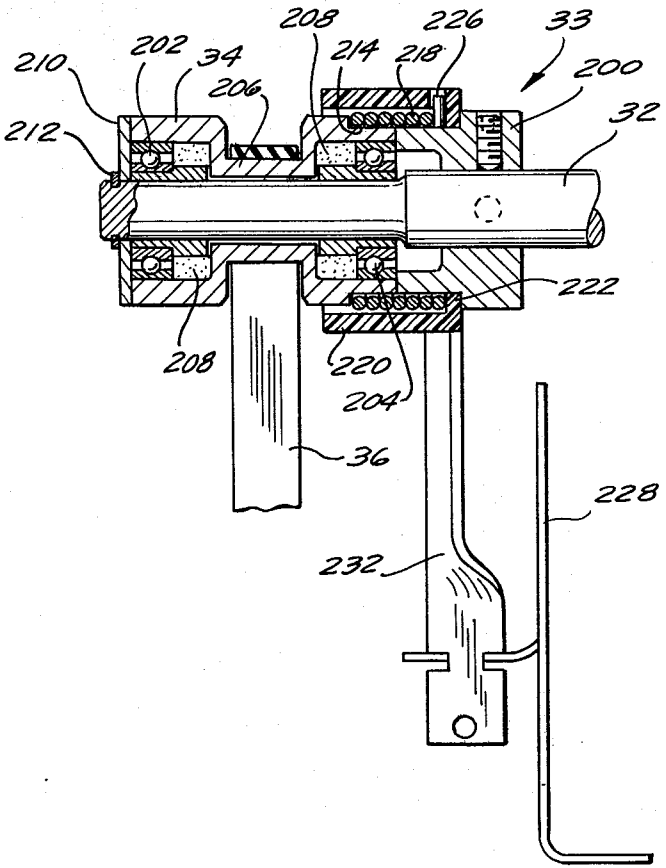
FIG. 11 is a vertical sectional view of the clutch mechanism.

More specifically, the motor 30 is provided with an output shaft 32 that drives a pulley 34 through a clutch mechanism 33. A drive belt 36 surrounds the drum 28 and the pulley 34 so that rotation of the pulley 34 by the drive shaft 32 through the clutch mechanism 33 causes concomitant rotation of the drum 28. More specifically, the clutch mechanism 33 comprises a clutch hub 200 (FIG. 11) that is secured to the shaft 32 by a set screw (not shown) or the like so that the hub rotates with the shaft. Spaced sleeve bearings 202 and 204 are also received on the shaft 32 and rotatably support the cylinder drive pulley 34. The pulley 34 is provided with a reduced diameter center portion 206 that is drivingly connected with the belt 36. Oil soaked felt rings 208 are received between the respective bearings 202 and 204 and the enlarged diameter portions of the pulley 34 and serve as reserve lubrication for the sleeve bearings. The pulley is retained in place on the shaft 32 by a thrust washer 210 and a retaining ring 212.

Pully 34 and clutch hub 200 are provided with aligned adjacent reduced diameter portions 214 and 216, respectively. Surrounding portions 214 and 216 is a clutch spring 218 that has an interference fit on the clutch hub 200 and the pulley 34. Rotatably received on the hub 200 and surrounding the spring 218 is an actuating shield 220 having a reduced diameter portion 222 that rides on the hub. The shield 220 includes a radially extending slot 224 that receives an upstanding tab 226 at one end of the spring 218.

Figure 10:
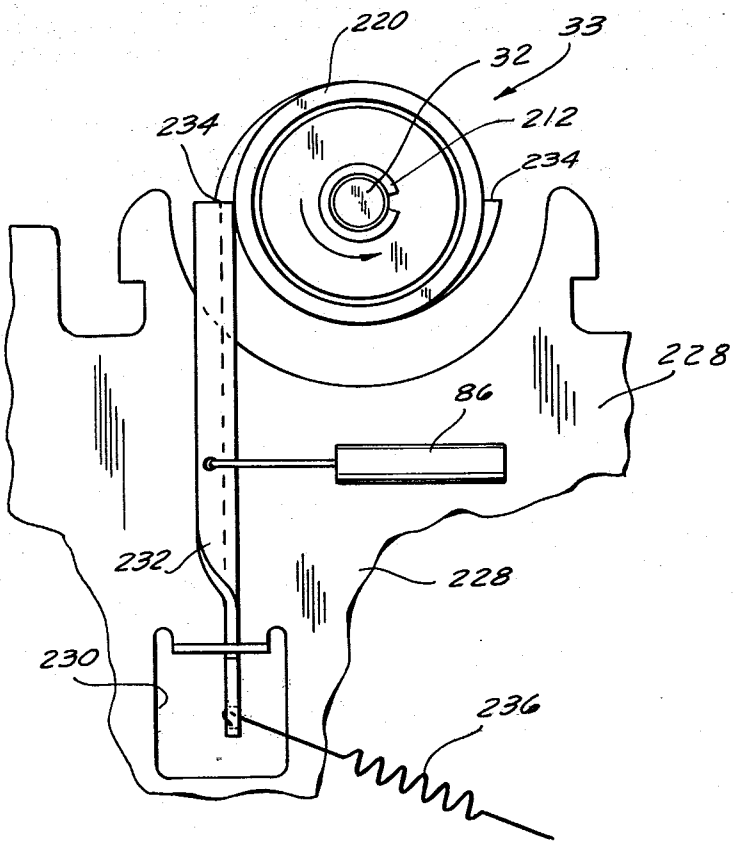
FIG. 10 is a front elevational view of a clutch mechanism that may be used in conjunction with the present control device.

Received on the motor mounting bracket 228 (FIG. 10) is a lever support bracket 230 that pivotally supports a clutch actuating lever 232. The shield 220 is provided with diametrically opposed radially extending latching tabs 234 that are adapted to be engaged by the lever 232 as shown by the solid line position of the lever in FIG. 10. However, the lever 232 is normally biased to the dotted line position shown in FIG. 10 by a spring 236 having one end connected to the lower end of the lever and the other end anchored to the bracket, for example. A Bowden cable 86 is connected to the lever 232 to permit control of the lever 232 by the control device, as noted below.

Under normal circumstances, when the dryer is performing a normal tumble dry operation, the lever 232 is out of contact with the shield 220. Accordingly, the pulley 34 is driven by the clutch hub 200 via the clutch spring 218. However, when it is desired to cause the dryer to perform a static dry cycle, the Bowden cable 86 is operated to bring the lever 232 to the full line position shown in FIG. 10. As the shield 220 rotates (by means of the tab 226 and slot 224) one of the latching tabs 234 will engage the lever 232 to arrest further rotation of the shield. This action prevents further rotation of the spring 218 via the tab 226 on the end coil of the spring. The direction of rotation of the hub is such that the spring unwraps from the hub thereby permitting the hub and motor shaft to rotate without rotating the pulley 34.

Accordingly, this clutch arrangement may be considered to be cycle changing apparatus that permits the dryer to be switched between a first or static dry cycle when the pulley is not driven by the shaft 32 and a second or normal tumble dry cycle when the pulley is in driving contact with the shaft, thereby causing the drum 28 to rotate. It should be noted, however, that this cycle changing apparatus is for illustrative purposes only and is not to be interpreted as being a limitation of the present invention. That is, any construction that selectively connects and disconnects the motor with the drive belt may be utilized.

As noted above, the foregoing cycle changing apparatus is particularly important in dryers that incorporate a so-called static dry feature. To be more specific, the drive motor 30 in the dryer is normally used to operate a number of mechanical elements within the dryer in addition to causing the drum 28 to rotate. For example, the motor is normally connected to a fan (not shown) within the dryer that causes the circulation of the hot air through the dryer drum. During a normal tumble dry operation, the motor 30 causes rotation of the drum via drive belt 36 and also drives the fan to cause the hot air to move through the drum. However, during a static dry cycle of operation, the drum 28 is stationary. However, the fan must continue to operate in order to cause the air to flow through the drum. Hence, the arrangement that includes the clutch mechanism 33 permits operation of the motor 30 without the concomitant rotation of the drum 28.

A problem is presented, however, when it is desired to switch from one cycle of operation to the other cycle of operation of the dryer. That is, if the switch-over occurs during the time that the motor 30 is energized a severe strain is placed on the driving belt 36 as well as on the other portions of the dryer that are driven by the motor 30. Accordingly, a control device designated generally by the reference numeral 42 in FIG. 1 is provided and is mounted on the control panel 22 of the dryer. The device 42 is operable to switch the dryer between its cycles of operation while automatically deenergizing the motor 30 during such switching operation.

Figure 2:
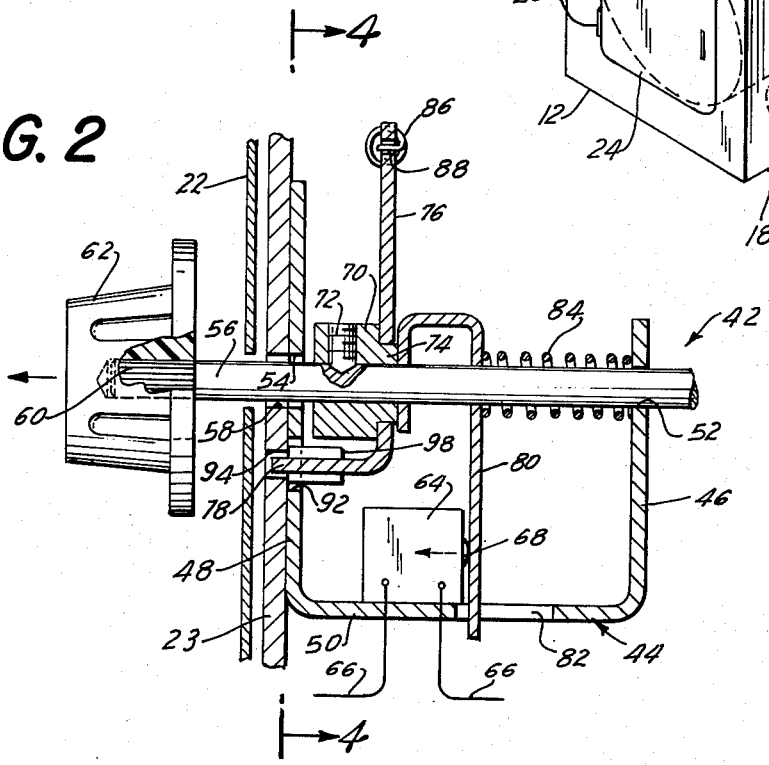
FIG. 2 is a sectional view of a control device constructed according to the present invention, taken along the line 2—2 of FIG. 1 and 2—2 of FIG. 6, showing the position of the various elements when the control device has been actuated to cause the dryer to perform a first cycle of operation.
Figure 3:
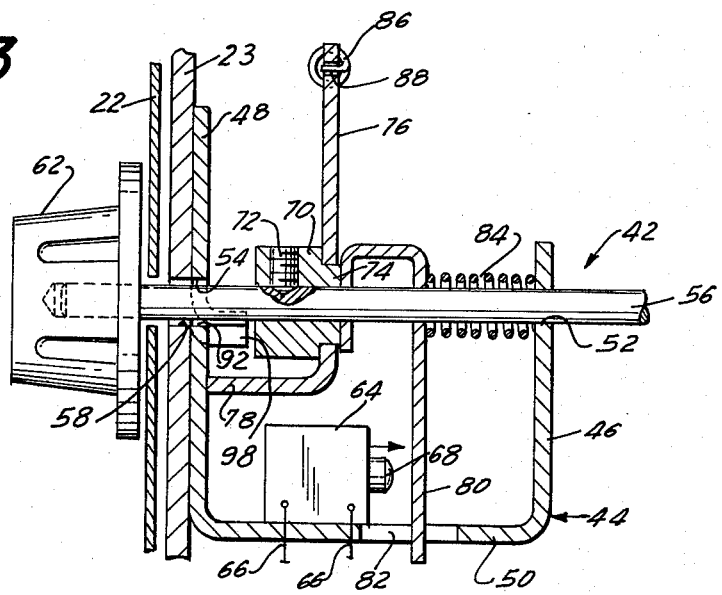
FIG. 3 is a sectional view of the control device taken along the line 3—3 of FIG. 5, showing the position of the elements for the mid-position of the control device as it is operated to cause the dryer to change cycles of operation.

The control device 42 is shown in detail in FIGS. 2–6 and includes a bracket 44 that is substantially U-shaped in profile and comprises a rear leg 46, a front leg or plate 48 that is slightly longer than the rear leg and a bight portion 50 between the legs 46 and 48. The leg 48 is affixed to the inner surface of the mounting bracket 23 behind the control panel 22 by any conventional means such as spot welding or by screws or the like. The mounting bracket 23 may be a portion of the bracket that mounts all of the dryer controls on the control panel 22. Provided in the legs 46 and 48 are aligned opening 52 and 54, respectively, that rotatably receive an actuating shaft 56 therethrough. The front end of the shaft 56 extends through an opening 58 in the mounting bracket 23, which opening is aligned with the openings 54 and 52, and terminates in a knurled portion 60 that fixedly receives a knob 62 thereon. It should be noted that the shaft 56 is rotatable and it may also be moved inwardly or toward the right as taken in FIG. 2. To be more specific, in addition to being rotatable, the shaft 56 may be moved from a normal position corresponding to the position shown in FIG. 2 to a depressed position as shown in FIG. 3, for reasons which will become apparent hereinbelow.

Received on the bight portion 50 of the bracket 44 is a microswitch 64. The microswitch is conventional in construction and is connected in series between the source of energy and the motor 30 by leads 66. In other words, the switch is operable between an open state and a closed state to connect the motor 30 in circuit with the source of energy. The switch is provided with a push button 68 which is normally spring-biased outwardly as shown in FIG. 3 when the switch is in the open or off state. However, the push button 68 is adapted to be depressed as shown in FIG. 2 to move the switch to the on or closed state thereby to connect the motor with the source of energy.

Mounted on the actuating shaft 56 are operating means that control the cycle of operation of the dryer and which operate the switch 64 to energize and to deenergize the motor. More specifically, a support block 70 is mounted on the shaft 56 and is affixed in place by a set screw 72. The block 70 includes a substantially rectangular shaped projection 74 that extends toward the right as taken in FIG. 2. A control lever 76 is provided with an opening formed complementary to the rectangular projection 74 and fixedly receives the projection 74 therethrough so that rotation of the shaft 56 causes concomitant rotation of the control lever 76 through the connection comprising the support block 70. The control lever terminates at one end in a forwardly extending projection 78. (In other words, the projection 78 extends toward the left, as taken in FIG. 2). As noted in greater detail below, the projection 78 may be considered a portion of a locking device that is connected to the shaft 56 and which is operable to lock the shaft in a particular position corresponding to one of the cycles of operation of the dryer.

Also mounted on the shaft 56 is a switch operating member 80 that rotatably receives the shaft through appropriate aligned apertures and which is positioned to engage the push button 68 of the switch 64. As shown in FIGS. 2 and 3, the member 80 extends through an opening 82 in the bight portion 50 of the bracket 44. The opening 82 prevents rotation of the member 80 while permitting forward and rearward movement of the member. A spring 84 surrounds the shaft 56 and abuts the leg 46 of the bracket at one end and, at the other end, the member 80, thereby biasing the member 80 against the support block 70. Since the support block is affixed to the shaft, the shaft will likewise be biased to the forward or normal position. As shown in FIG. 2, for the normal position of the shaft 56, the member 80 will engage and depress the push button 68 thereby operating the switch 64 to the closed or on state.

A Bowden cable 86 is received at one end through an aperture 88 adjacent the end of the control lever 76 and is connected at the other end to the lever 232 so that movement of the control lever 76 causes the pulley 34 to move into and out of engagement with the output shaft 32 of the motor 30. Accordingly, movement of the control lever thereby causes the dryer to effect either a normal tumble dry cycle or a stop-and-dry cycle of operation.

Figure 4:
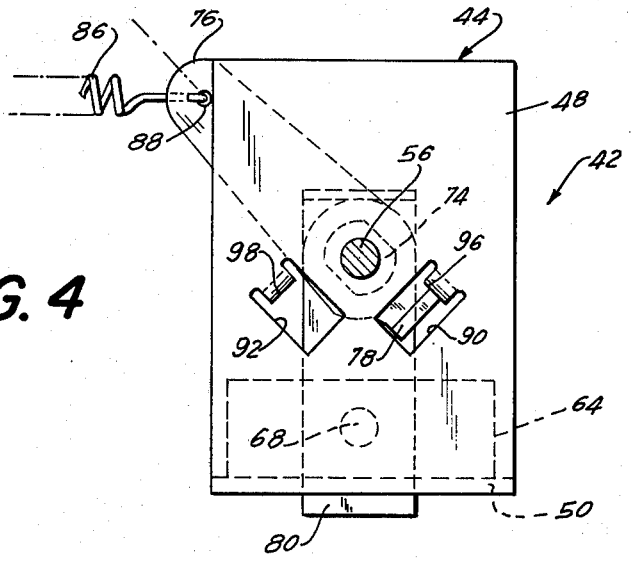
FIG. 4 is a front elevational view of the control device, illustrating the position of the elements when the control device has been operated to cause the dryer to perform a second cycle of operation.
Figure 5:
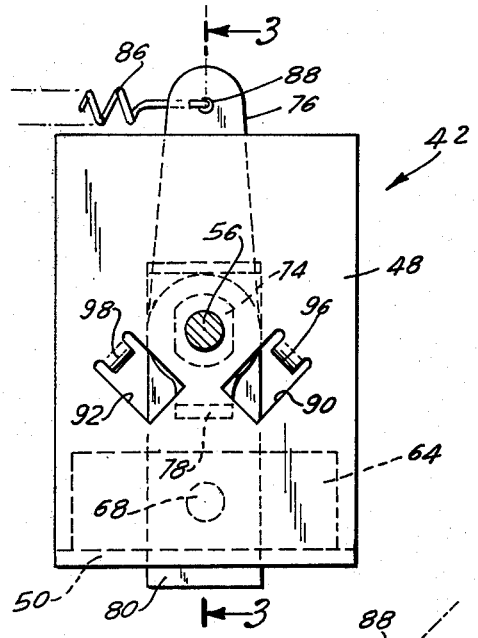
FIG. 5 is a front elevational view showing the position of the elements for the mid-position of the control device.

As shown in FIGS. 4 and 5, the leg 48 of the bracket 44 is provided with angularly spaced openings 90 and 92. Openings aligned with the openings 90 and 92 are also provided in the mounting bracket 23 such as opening 94 which is aligned with opening 92, as shown in FIG. 2. The openings 90 and 92 may be formed by cutting spaced strips on either side of a center portion, severing one end of the center portion and bending the center portion rearwardly or toward the right as taken in FIGS. 2 and 3, so that the center portions form rearwardly or inwardly projecting fingers, respectively designated 96 and 98, that limit rotation of the shaft 56 in the manner indicated below. However, this construction is for illustrative purposes only as any type of stop arrangement may be used to limit rotation of the shaft.

The openings 90 and 92 are sized to receive the projection 78 therethrough. Moreover, the openings 90 and 92 are positioned on the leg 48 so that they correspond to the position of the control lever 76 when the control lever is in the correct orientation to cause the dryer to execute the desired cycle of operation. To be more specific, when the dryer is to execute a normal tumble dry cycle of operation, the actuating shaft 56 is rotated to orient the control lever 76 so that it is in the position shown in FIG. 4. For this position of the control lever, the projection 78 will be received in the opening 90. However, when the shaft 56 is rotated to cause the control lever 76 to move to the position shown in FIG. 6, the projection 78 will be received in the opening 92 and the pulley 34 will have been moved out of contact with the output shaft 32 of the motor 30. Accordingly, the dryer will now execute a static dry cycle.

In operation, it will be assumed that the control device 42 has been operated to cause the dryer to execute a static dry cycle of operation. Accordingly, the elements comprising the control device will be in the positions shown in FIGS. 2 and 6. When it is desired to change cycles so that the dryer executes a normal tumble dry cycle of operation, the actuating shaft 56 is depressed until the projection 78 is moved out of the opening 92. (In the interests of clarity, the lock washers which are received on the shaft 56 and which limit the amount of movement of the shaft have not been shown in the drawings.) The projection 78 is sized so that when the shaft is moved rearwardly against the bias of the spring 84, the switch operating member 80 is moved out of engagement with the pushbutton 68 of the switch 80. Accordingly, since the movement of the member 80 is concomitant with the rearward movement of the shaft 56, the motor will be deenergized before rotation of the control lever 76 can occur.

Figure 6:
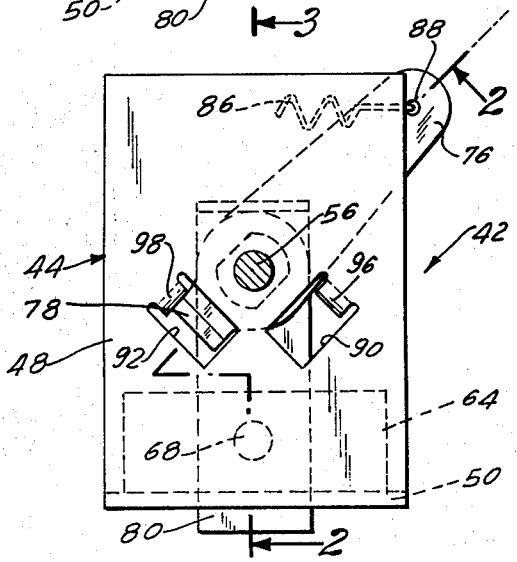
FIG. 6 is a front elevational view of the control device, showing the position of the elements when the control device has been operated to cause the dryer to perform a first cycle of operation.

After the projection 78 has been moved out of the opening 92, the shaft 56 may be rotated counterclockwise as taken in FIGS. 4–6. Thus, the control lever 76 will likewise rotate and, via the Bowden wire 86, permit the pulley 34 to move into engagement with the output shaft 32 of the motor so that the dryer will execute a conventional tumble dry cycle of operation. The shaft 56 is rotated until the projection 78 engages the finger 96. Accordingly, the finger 96 and, similarly, the finger 98 perform two functions. That is, the fingers limit the rotation of the control lever and they also automatically align the projection 78 with the associated opening. After the control lever 76 has been rotated to the position shown in FIG. 4, the shaft may be released. Accordingly, the spring 84 will now bias the member 80 and the control lever 76 forwardly or toward to the left as taken in FIGS. 2 and 3. Hence, the projection 78 will be received in the opening 90 and the member 80 will again depress the switch pushbutton 68 to energize the motor.

The projection 78 and the opening 90 and 92 effectively prevent an operator from changing the cycle of operation until the actuating shaft is depressed. However, the depression of the actuating shaft automatically deenergizes the motor. Thus, the control device effectively prevents changing the cycle of operation of the dryer until the motor has been deenergized, thereby eliminating any possible strain on the moving parts of the invention.

When it is desired to change back to a static dry cycle of operation, the actuating shaft is again depressed but the shaft is now rotated clockwise until the projection 78 abuts the finger 98. The shaft may then be released to permit the member 80 to again depress the pushbutton to energize the motor.

Figure 7:
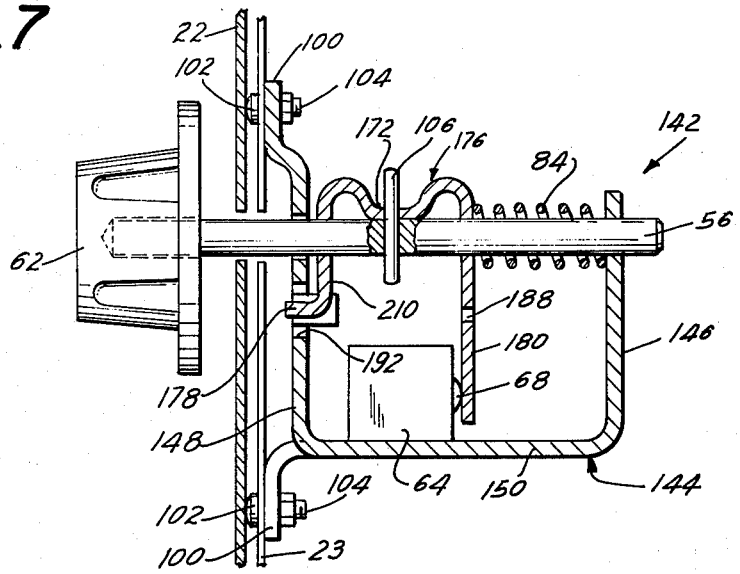
FIG. 7 is a vertical sectional view of a modified embodiment of a control device constructed according to the present invention.
Figure 8:
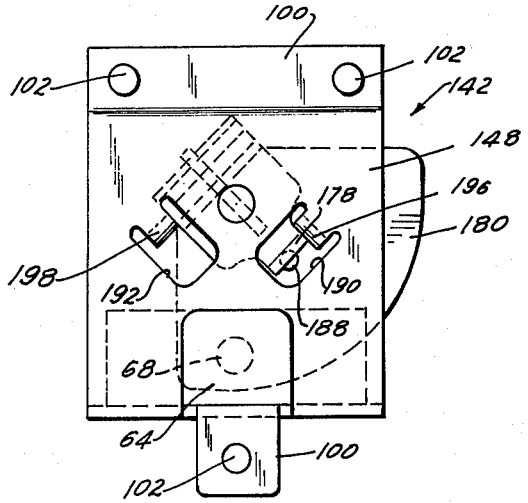
FIG. 8 is a front elevational view thereof, showing the position of the elements of the control device when the control device has been operated to cause the dryer to perform a second cycle of operation.
Figure 9:
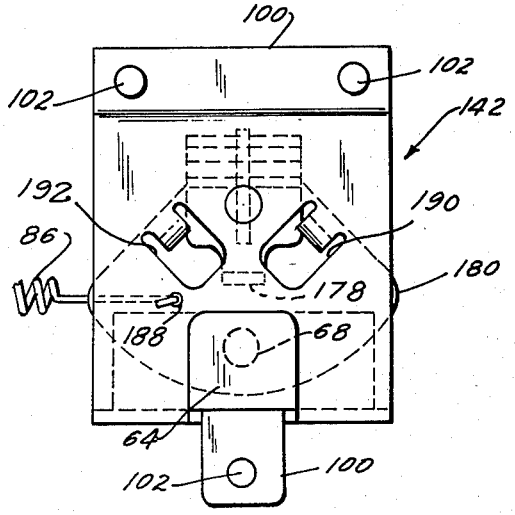
FIG. 9 is a front elevational view of the control device shown in FIG. 7, illustrating the mid-position of the control device.

A modified embodiment of the control device constructed according to the present invention is shown in FIGS. 7–9, wherein like numbers in all the figures indicate identical elements. Elements in the embodiment of FIGS. 7–9 that are similar to elements in the embodiment shown in FIGS. 1–6 are indicated by the identical suffix numeral but are preceded by the prefix numeral 1. For example, the control device in FIGS. 7–9 corresponding to the control device 42 of FIGS. 1–6 is indicated by the reference character 142.

Accordingly, the control device 142 comprises a U-shaped bracket 144 having opposed legs or plates 146 and 148 connected by a bight portion 150. The legs 146 and 148 rotatably receive the actuating shaft 56 therethrough. Additionally, the leg 148 is provided with offset portions 100 which receive screws 102 therethrough and which are respectively secured by nuts 104 to secure the bracket to the mounting bracket 23. As shown in FIG. 7, the off-set portions 100 project forwardly of the leg 148 to space the leg from the mounting bracket 23. This spacing eliminates the need to place openings in the mounting bracket 23 to receive the projection of the locking device that prevents rotation of the shaft until it is depressed.

The basic difference between the embodiment of FIGS. 7–9 and the control device 42 is the fact that the control lever and the separate switch operating member have been eliminated from the modified embodiment of FIGS. 7–9. More specifically, a member 176 is received on the shaft 56 and includes an enlarged depending wedge-shaped member 180. The member 180 has an angular width such that it will always overlie the switch 64 mounted on the bight portion 150 as the shaft 56 is rotated through its operative arc. In other words, the member 180 will always be in facing relationship to the switch 64 as the shaft 56 is rotated from one position corresponding to the first cycle of operation of the dryer to the other terminal position corresponding to the second cycle of operation of the dryer.

The upper portion of the member 176 is depressed at 172 so that it contacts the shaft 56. A pin 106 is press fitted through appropriate through bores in the member 176 and the shaft 56 to affix the member 176 to the shaft so that rotation of the shaft causes concomitant rotation of the member 176.

The member 176 further includes a front or forward leg portion 210 having a forwardly extending projection 178 at the end thereof. The projection 178 is adapted to be received in angularly spaced openings 190 and 192 on the leg 148 similarly to the openings 90 and 92 on the leg 48. Fingers or stops 196 and 198 are positioned at the ends of the openings 190 and 192 and function in the same manner as the fingers or stops 96 and 98 in FIGS. 2–6. Additionally, an opening 188 is provided on the member 180 that is adapted to receive the end of the Bowden wire 86 therein.

In operation of the embodiment of FIGS. 7–9, it will be noted that the position of the locking arrangement comprising the projection 178 and the openings 190 and 192 will be reversed with respect to the cycle of operation of the machine as compared with the position of the elements in the embodiment shown in FIGS. 2–6. That is, when it is desired to cause the dryer to execute a static dry cycle of operation, the projection 178 will be received in the opening 190. The reason for this reversal is due to the fact that the aperture 188 and the member 180 is below the shaft whereas the aperture 88 in the control lever 76 is above the shaft.

Assuming that the machine is performing a static dry cycle, the arrangement of the elements comprising the control device 142 will be in a position shown in FIG. 8 wherein the projection 178 is received in the opening 190 in the leg 148 of the bracket. When it is desired to change the cycle of operation to a normal tumble dry cycle, the shaft 56 is depressed thereby moving the leg 188 rearwardly as taken in FIG. 7. The pushbutton 68 of the switch 64 will move outwardly to cause the switch to open as the projection 178 is moved out of the opening 190. The shaft 56 may then be rotated in the clockwise direction until the projection 178 abuts the finger or stop 198 at which point the projection will be aligned with the opening 192 and the Bowden wire connection will have set the dryer for a tumble dry cycle. The knob 62 may be released at this point and the spring 84 will bias the shaft to the normal position whereupon the projection 178 will enter the opening 192 to prevent rotation of the actuating shaft. Additionally, the member 180 of the member 176 will engage and depress the pushbutton 68 to again close the switch 64 to permit energization of the control motor.

While preferred embodiments of the invention have been shown and described herein, it will become obvious that numerous omissions, changes and additions may be made in such embodiments without departing from the spirit and scope of the present invention.

What is claimed is:

1. A control device for a dryer of the type having a drum, a drive belt surrounding said drum and drivingly connected thereto, and a motor connected to said belt for rotating said belt, said dryer being operable to perform at least a first type of cycle in which said drum is rotated and a second type of cycle in which said drum is stationary; said control device comprising:

a switch movable between an off state and an on state to connect the motor in circuit with a source of energy, an actuating shaft, mounting means for mounting said actuating shaft on said dryer for rotational movement between a first positoin corresponding to the first type of cycle of operation of the dryer and a second position corresponding to the second type of cycle of operation of the dryer and for movement between a normal and a depressed position, control means on said shaft for engaging said switch when said actuating shaft is in said normal position to move said switch to the on state and for causing operation of said switch to the off state when said actuating shaft is in said depressed position, and lock means for preventing rotation of said shaft when said shaft is in said normal position and being responsive to movement of said shaft to the depressed position to permit rotation thereof.

2. A control device as in claim 1, and biasing means for biasing said actuating shaft to said normal position.

3. A control device as in claim 1 in which said dryer is provided with cycle changing means, and connecting means having one end connected to said control means and another end connected to said cycle changing means of the dryer to change the cycle of operation of the dryer between said first and second types as said actuating shaft is moved between said first and second position.

4. A control device as in claim 2, in which said switch comprises a button adapted to be depressed to move said switch to the on state, and said control means comprises a lever fixedly mounted on said actuating shaft, and a switch operating member rotatably receiving said actuating shaft therethrough, said biasing means comprising a spring engaging said switch operating member to bias said switch operating member into engagement with said switch to depress said button, said lever being positioned on said actuating shaft to engage and move said switch operating member away from said switch when said shaft is depressed.

5. A control device as in claim 4, in which said lock means comprises a projection extending outwardly from said lever, and a plate in facing relationship to said projection and having spaced apertures therein that are respectively aligned with said projection when said shaft is in said first and said second positions, said projection being sized to be received in one of said apertures when said shaft is in said normal position and to be spaced from said apertures when said shaft is in said depressed position, whereby said shaft may be rotated between said first and second positions when said shaft is moved to said depressed position.

6. A control device as in claim 5, and a pair of fingers on said plate positioned to engage said projection when said shaft is in said first or second position to prevent rotation of said shaft therebeyond.

7. A control device as in claim 2, in which said switch comprises a button adapted to be depressed to move said switch to the on state, and said control means comprises a switch operating member on said shaft positioned to engage and depress said button when said shaft is in the normal position and positioned to release said button when said shaft is moved to the depressed position, and said biasing means comprises a spring bearing against said switch operating member to urge said shaft to said normal position.

8. A control device as in claim 7, in which said lock means comprises a projection connected to said shaft, and a plate in facing relationship to said projection and having spaced apertures therein that are respectively aligned with said projection when said shaft is in said first and said second positions, said projection being sized to be received in one of said apertures when said shaft is in said normal position and to be spaced from said apertures when said shaft is in said depressed position, whereby said shaft may be rotated between said first and second positions when said shaft is moved to said depressed position.

9. A control device as in claim 8, and a pair of fingers on said plate positioned to engage said projection when said shaft is in said first or second position to prevent rotation of said shaft therebeyond.

10. A dryer having a drum; motor means for operating mechanical devices in said dryer; a belt surrounding said drum for rotating said drum; and cycle changing means connected between said belt and said motor means for changing the cycle of operation of said dryer between a first cycle in which said drum is rotated and a second cycle in which said drum is stationary; and a control device for deenergizing said motor as the cycle of operation of the dryer is switched between said first and second cycles; said control device comprising a switch movable from an open to a closed state to connect said motor means in circuit with a source of energy, an actuating shaft mounted on said dryer for movement between first and second positions and third and fourth positions, operating means between said shaft and said cycle changing means for operating said cycle changing means to change the cycles of operation of said dryer between said first and second cycles as said shaft is rotated between said first and second positions, switch operating means on said shaft responsive to movement of said shaft from said third to said fourth position for operating said switch to said closed state, and lock means connected with said shaft to prevent movement of said shaft between said first and second positions while said shaft is in said fourth position.

11. A dryer as in claim 10, and biasing means for normally urging said shaft to said fourth position.

12. A dryer as in claim 10, in which said shaft is rotatable between said first and second positions and is depressable from said fourth to said third position, and said switch comprises a button normally residing in a position corresponding to the open state of said switch and being depressable to a position corresponding to the closed state of said switch, said switch operating means comprising a plate on said shaft positioned to depress said button when said shaft is in said fourth position and to permit movement of said button to the normal position when said shaft is in said third position.

13. A dryer as in claim 12, in which said lock means comprises a projection connected to said shaft, and a plate in facing relationship to said projection and having spaced apertures therein that are respectively aligned with said projection when said shaft is in said first and second positions, said projection being sized to be received in one of said apertures when said shaft is in said fourth position and to be spaced from said apertures when said shaft is in said third position, whereby said shaft may be rotated between said first and second positions when said shaft is in said third position.

14. A dryer as in claim 13, and a pair of fingers on said plate positioned to engage said projection when said shaft is in said first or second position to prevent rotation of said shaft therebeyond.

15. A dryer as in claim 13, in which during said first cycle of operation said drum is rotated and during said second cycle of operation said drum is stationary; said motor means comprising a motor, and drive means for rotating said drum; said cycle changing means comprising disabling means for disabling said drive means to prevent rotation of said drum when said shaft is in said second position.

* * * * *